US006726383B2

(12) United States Patent
Huang

(10) Patent No.: US 6,726,383 B2
(45) Date of Patent: Apr. 27, 2004

(54) COLOR PRINTER WITH A SINGLE SENSOR FOR DETECTING INK RIBBON POSITION

(75) Inventor: Kuan-Chih Huang, Taipei Hsien (TW)

(73) Assignee: Hi-Touch Imaging Technologies Co., Ltd., Pan-Chiao (TW)

( * ) Notice: Subject to any disclaimer, the term of this patent is extended or adjusted under 35 U.S.C. 154(b) by 31 days.

(21) Appl. No.: 09/683,727

(22) Filed: Feb. 7, 2002

(65) Prior Publication Data

US 2003/0035676 A1 Feb. 20, 2003

(30) Foreign Application Priority Data

Aug. 16, 2001 (TW) ..... 90120143 A

(51) Int. Cl.[7] ..... B41J 2/325; B41J 35/16

(52) U.S. Cl. ..... 400/120.04; 347/178

(58) Field of Search ..... 400/120.04, 120.01, 400/120.02, 36, 201; 345/467, 472.3; 358/1.1, 1.18; 347/177, 178, 175; 101/96, 100, 102, 107, 243, 244, 271, 273, 274, 281, 332, 336

(56) References Cited

U.S. PATENT DOCUMENTS 6,010,258 A * 1/2000 Tomita et al. ..... 400/120.02
6,071,024 A 6/2000 Chi-Ming et al.
6,396,526 B1 * 5/2002 Sung et al. ..... 347/178
6,509,920 B2 * 1/2003 Sung et al. ..... 347/178

FOREIGN PATENT DOCUMENTS

TW 87110337 7/2000

* cited by examiner

*Primary Examiner*—Stephen R. Funk
*Assistant Examiner*—Hoai-An D. Nguyen
(74) *Attorney, Agent, or Firm*—Winston Hsu

(57) ABSTRACT

A color printer with a single photo sensor for detecting the position of the ink ribbon. A single photo sensor is place so that it can detect transparent and opaque sections of the ink ribbon. The ribbon winds at a constant speed, so the pattern of transparent and opaque sections periodically repeats. The controller can use the periodicity of the transparent and opaque sections to calculate which dye frame the print head is positioned over. Using this information, the printer can advance the ink ribbon to the desired dye frame for printing onto the photo paper.

13 Claims, 7 Drawing Sheets

| Colors of frames and diving sections | Yellow | Magenta | Cyan | Over coating | Opague | Transparent |
|---|---|---|---|---|---|---|
| Output signals | First status | Second status | Second status | First status | Second status | First status |
| Voltage signals | High voltage status | Low voltage status | Low voltage status | High voltage status | Low voltage status | High voltage status |
| Digital signals | 1 | 0 | 0 | 1 | 0 | 1 |

Fig. 4

COLOR PRINTER WITH A SINGLE SENSOR FOR DETECTING INK RIBBON POSITION

BACKGROUND OF INVENTION

1. Field of the Invention

The present invention relates to a color printer and more particularly, to a color printer with a single photo sensor for detecting the position of an ink ribbon.

2. Description of the Prior Art

Please refer to FIG. 1, FIG. 1 is a perspective view of a ribbon apparatus 10 of a prior art color printer. As shown in FIG. 1, the ribbon apparatus 10 of the color printer comprises an ink ribbon 12, two light sources 32, 52, and two sensors 36, 56. The ink ribbon 12 comprises a plurality of sequentially arranged dye regions 14. Each dye region 14 comprises four dye frames 16, 18, 20, 22 for placing yellow dye, magenta dye, cyan dye, and over coating dye. An opaque dividing section 24 is located between an over coating dye frame 22 and a yellow dye frame 16. An opaque dividing section 27 and a transparent dividing section 26 are installed between the yellow dye frame 16 and a magenta dye frame 18. An opaque dividing section 27 and a transparent dividing section 26 are installed between the magenta dye frame 18 and a cyan dye frame 20. An opaque dividing section 27 and a transparent dividing section 26 are installed between the cyan dye frame 20 and the over coating dye frame 22.

The light sources 32, 52 are located on one side of the ink ribbon 12 for producing light beams 34, 54 with two predetermined colors. The sensors 36, 56, corresponding to the light sources 32, 52, are located on the opposite side of the ink ribbon 12. The sensors 36, 56 are used to detect light beams 34, 54 penetrating through the ink ribbon 12 and produce corresponding signals to determine the position of the ink ribbon. The detection of an opaque dividing section 24 signals the beginning position of a new dye region 14 of the ink ribbon 12, and also corresponds to the beginning position of a yellow dye frame 16. The detection of an opaque dividing section 27 and a transparent dividing section 26 by the sensors 36, 56 corresponds to the beginning position of the magenta dye frame 18, cyan dye frame 20, or over coating dye frame 22. The use of two sets of light sources 26, 28 and sensors 30, 32 for detection of the position of the ink ribbon 12 is a disadvantage of the prior art color printer because it increases the amount of parts used, resulting in higher production costs.

SUMMARY OF INVENTION

It is therefore a primary objective of the claimed invention to provide a color printer with a single sensor for detecting the position of the ink ribbon for solving the above-mentioned problem.

According to the claimed invention, a color printer with a photo sensor for detecting the position of the ink ribbon is provided. The color printer includes an ink ribbon, a print head, a ribbon-driving device, a controller, and a photo sensor. The ink ribbon includes a plurality of sequentially arranged dye regions. Each dye region includes a plurality of dye frames of different colors. The print head is used to thermally transfer the dye on the ink ribbon onto photo paper. The ribbon-driving device is used to move the ink ribbon in a predetermined direction at a predetermined speed. The print head transfers the dye on each of the dye frames of one dye region onto the photo paper one by one in order to form a color picture. The controller is used to control the operations of the color printer. The photo sensor is used to illuminate the ink ribbon and produce corresponding output signals. The photo sensor outputs a signal of either a first status or a second status. When the controller utilizes the ribbon-driving device to move the ink ribbon in the predetermined direction, a period of time that has passed since the last change in status generated by the photo sensor is used to identify the position of the ink ribbon.

It is an advantage compared to the prior art that the color printer of the claimed invention only needs a single optical sensing system to detect the position of the ink ribbon. The beginning position of each dye frame in the ink ribbon is determined by a digital method, fewer parts are used, and production costs are lowered.

These and other objectives of the claimed invention will no doubt become obvious to those of ordinary skill in the art after reading the following detailed description of the preferred embodiment, which is illustrated in the multiple figures and drawings.

BRIEF DESCRIPTION OF DRAWINGS

FIG. 4 is a table contrasting output signals with each corresponding dye frame and dividing section.

DETAILED DESCRIPTION

Figure 1:
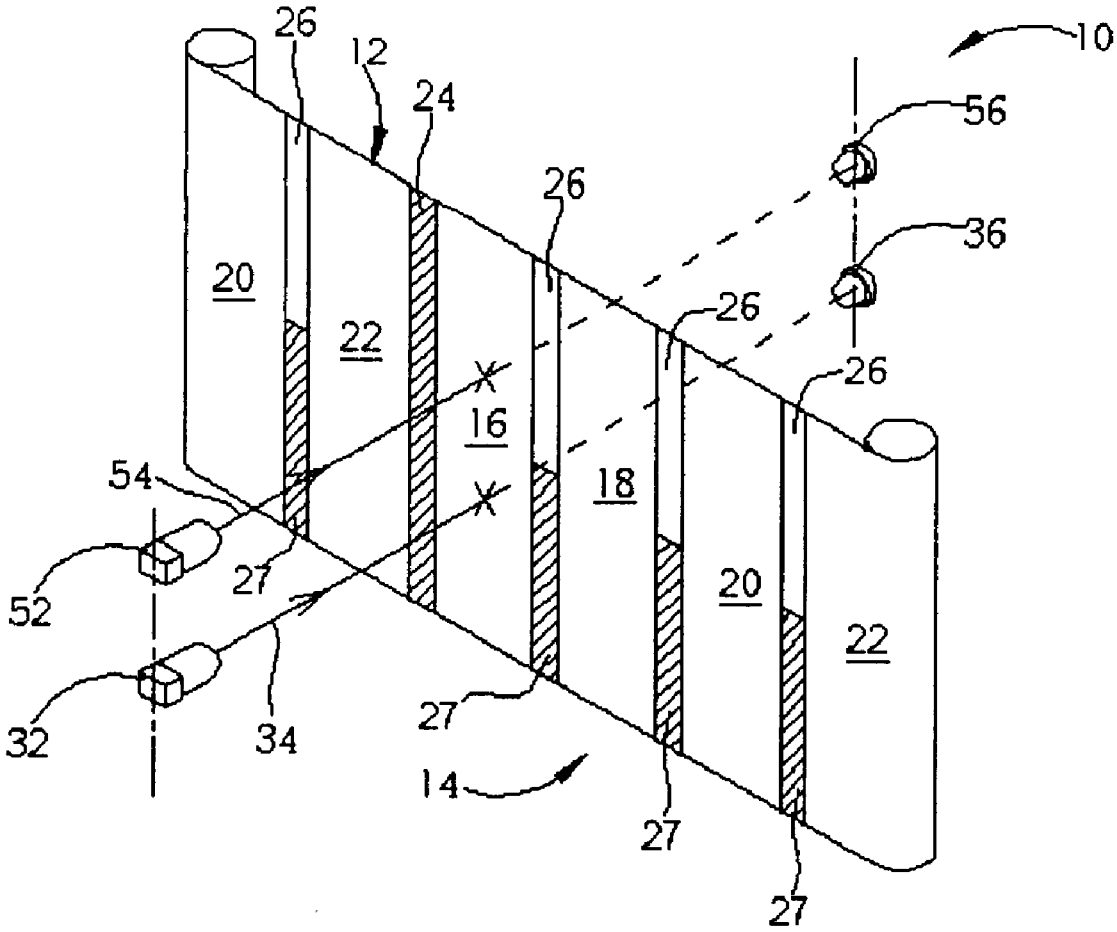
Fig. 1 Prior art
FIG. 1 is a perspective view of a ribbon apparatus 10 of a prior art color printer.
Figure 2:
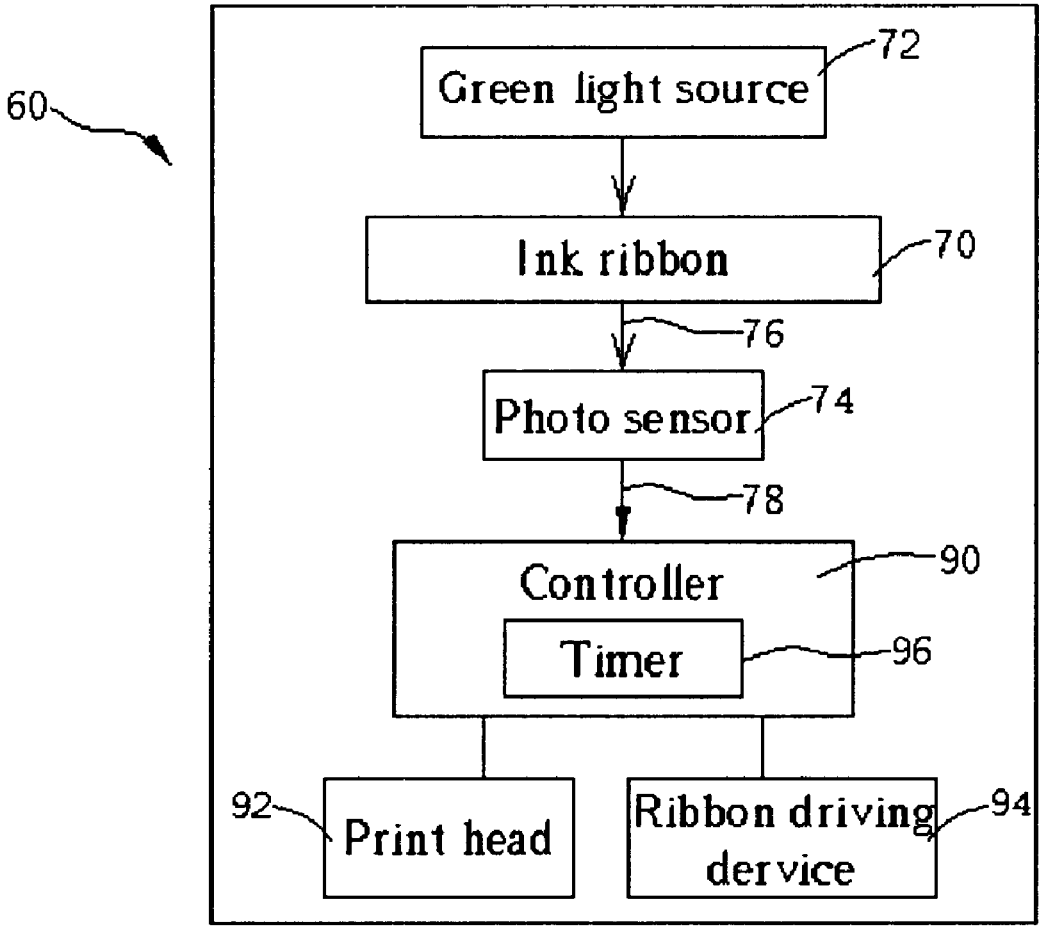
FIG. 2 is a functional block diagram of a color printer 60 according to the present invention.
Figure 3:
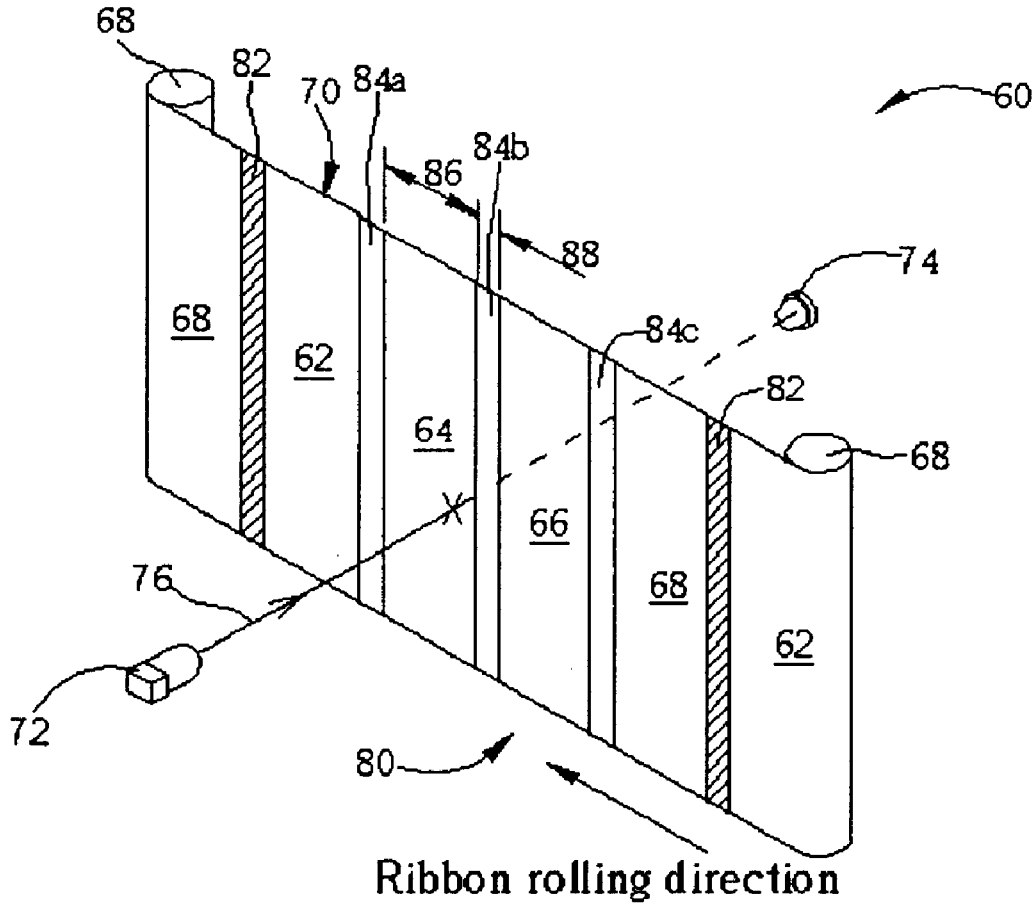
FIG. 3 is a perspective view of a ribbon apparatus 60 of a color printer according to the present invention.

Please refer to FIG. 2 and FIG. 3. FIG. 2 is a functional block diagram of a ribbon apparatus 60 of a color printer according to the present invention. FIG. 3 is a perspective view of a ribbon apparatus 60 of a color printer according to the present invention. The ribbon apparatus 60 is a part of a photo printer for printing on photo paper. The ribbon apparatus 60 comprises an ink ribbon 70, an optical sensing system, a controller 90, a print head 92, and a ribbon driving device 94. The optical sensing system further comprises a green light source 72 and a photo sensor 74. The ink ribbon 70 is installed inside a ribbon cartridge in a windable manner. The ribbon driving device 94 is used for winding the ink ribbon 70 inside the ribbon cartridge so that the ink ribbon 70 is rolled in a predetermined direction. The ink ribbon 70 comprises a plurality of sequentially arranged dye regions 80. Each of the dye regions 80 comprises four dye frames 62, 64, 66, 68 for carrying dye of different colors, and each of the dye frames 62, 64, 66, 68 has a substantially equal first length 86. The dye frames 62, 64, 66, 68 are used for separately placing yellow dye, magenta dye, cyan dye, and over coating dye. Dividing sections 82, 84*a*, 84*b*, 84*c* are positioned at the front end of each of the dye frames 62, 64, 66, 68 respectively. Each of the dividing sections 82, 84*a*, 84*b*, 84*c* has a substantially equal second length 88, which is shorter than the first length 86. The dividing sections 82, 84*a*, 84*b*, 84*c* are opaque, transparent, transparent, and transparent, respectively, and are used to signal to the controller 90 a beginning position of each of the dye frames 62, 64, 66, 68. The controller 90 is utilized to control the color printer 60. The controller 90 comprises a timer 96, which is used to record a time required for the ribbon driving device 94 to move the ink ribbon 70 to different dye regions 80. The details of the operating mechanism are described in FIG. 5 and FIG. 7. The print head 92 is used to print the dye on the ink ribbon 70 onto the photo paper. The ribbon driving device 94 winds the ink ribbon 70 inside the ribbon cartridge at a constant linear speed or at a constant angular speed, and the print head 92 prints the dye on the dye frames 62, 64, 66, 68 in the dye region 80 onto photo paper sequentially so as to form a pattern of colors.

As shown in FIG. 2 and FIG. 3, the optical sensing system of the color printer 60 is located on both sides of the ink ribbon 70. The optical sensing system comprises a green light emitting diode (i.e. green light source 72) positioned on one side of the ink ribbon 70 for emitting a green light beam 76 toward the ink ribbon 70, and a photo sensor 74 positioned on the other side of the ink ribbon 70 for detecting the green light beam 76 penetrating the ink ribbon 70 and generating corresponding output signals 78. The output signals 78 comprise either a first status or a second status. In the present embodiment, the output signals 78 are voltage signals where the first status is high voltage status and the second status is low voltage status. When the controller 90 utilizes the ribbon driving device 94 to wind the ink ribbon 70, the photo sensor 74 detects the green light beam 76 penetrating the dye region 80 and generates output signals 78. The controller 90 will then determine the position of the ink ribbon 70 according to a duration of time that has passed since the output signals 78 last shifted from one status to another status. This duration is referred to as the status-to-status duration. Once the position of the ink ribbon 70 is known, the controller 90 will control the ribbon driving device 94 and the print head 92 to move the ink ribbon 70 to the proper location and complete the printing process.

Figure 5:
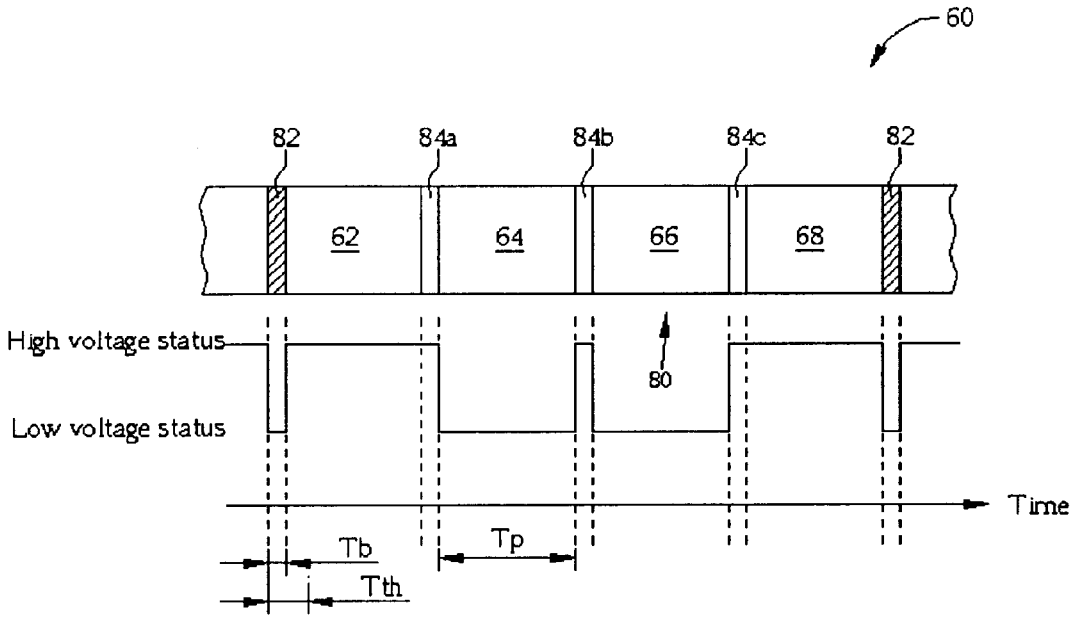
FIG. 5 is a time sequence diagram of the output signals generated by the optical sensing system shown in FIG. 3.

Please refer to FIG. 4 and FIG. 5. FIG. 4 is a table contrasting output signals with each corresponding dye frame and dividing section. FIG. 5 is a time sequence diagram of the output signals generated by the optical sensing system shown in FIG. 3. As shown in FIG. 4, the green light source 72 has higher penetration rates for the yellow dye frame 62, the over coating dye frame 68, and the transparent dividing sections 84*a*, 84*b*, 84*c*. As a result, when the green light beam 76 passes through the yellow dye frame 62, the over coating dye frame 68, and the transparent dividing sections 84*a*, 84*b*, 84*c*, the output signal 78 is of the first status (i.e. high voltage status), and its digital signal is represented by "1". The green light source 72 has lower penetration rates for the magenta dye frame 64, the cyan dye frame 66, and the opaque dividing section 82. Therefore, when the green light beam 76 passes through the magenta dye frame 64, the cyan dye frame 66, and the opaque dividing section 82, the sensing signal 78 is of the second status (i.e. low voltage status), and its digital signal is represented by "0".

As shown in FIG. 5, when two adjacent sections of an ink ribbon 70 having different penetration rates pass by the photo sensor 74 sequentially, the photo sensor 74 will detect a status variation. For example, the output signal 78 of the photo sensor 74 could go from high voltage status to low voltage status, or from low voltage status to high voltage status. In the present embodiment, when the controller 90 receives the output signal 78 generated by the photo sensor 74, the timer 96 records the status-to-status duration of the output signal 78 and compares the status-to-status duration with a threshold time $T_{th}$ to determine the position of the ink ribbon 70. After the controller 90 determines the position of the predetermined dye frame, the controller 90 discerns the position of the other dye frames, and the print head 92 prints the dye on other dye frames onto the photo paper sequentially.

When printing the dye on the dye frame 62, 64, 66, 68 in a dye region 80 of the ink ribbon 70 onto the photo paper, the ribbon driving device 94 winds the ink ribbon 70 inside the ribbon cartridge at the constant linear speed. Therefore, each of the dye frames 62, 64, 66, 68 has a sensing time equal to that of any other dye frame, referred to as first time $T_p$, generated by the timer 96 inside the controller 90. Similarly, each of the dividing sections 82, 84, 84, 84 has another sensing time equal to that of any other dividing section, referred to as second time $T_b$. The first time $T_p$ is longer than the threshold time $T_{th}$, which is longer than the second time $T_b$. In general, the printing order of the ink ribbon 70 is the yellow dye frame 62, the magenta dye frame 64, the cyan dye frame 66, and the over coating dye frame 68. As a result, when determining the beginning position of the ink ribbon 70, the color printer has to search for the yellow dye frame 62, the magenta dye frame 64, the cyan dye frame 66, and the over coating dye frame 68, in that order. The details is described as follows (please refer to FIG. 3, FIG. 4 and FIG. 5): Step 160: Search for the yellow dye frame 62. Turn on the green light source 72 and the photo sensor 74, and wind the ink ribbon 70 at the constant linear speed or at the constant angular speed.

Step 162: When the digital signal of the output signal goes from "1" to "0", the timer 96 starts to count time, and the ink ribbon 70 is continuously wound at the constant linear speed.

Step 164: When the digital signal of the output signal goes from "0" to "1", and the time recorded by the timer 96 is shorter than the threshold time $T_{th}$, the beginning position of the yellow dye frame 62 is detected, and the color printer 60 can start to print the dye on the yellow dye frame 62 onto the photo paper. When the time recorded by the timer 96 is longer than the threshold time $T_{th}$ and the digital signal of the output signal doesn't go from "0" to "1" yet, the photo sensor 74 is still positioned within the magenta dye frame 64 or the cyan dye frame 66, and the search process goes back to step 162 to keep searching for the yellow dye frame 62.

Step 166: Search for the magenta dye frame 64. Because printing of the dye on yellow dye frame 62 onto the photo paper has just finished, the photo sensor 74 must still be within the yellow dye frame 62. Continuously wind the ink ribbon 70. When the digital signal of the output signal generated by the photo sensor 74 goes from "1" to "0", the beginning position of the magenta dye frame 64 is detected. Then, start to print the dye on the magenta dye frame 64 onto the photo paper. Thereafter perform step 168 to search for the cyan dye frame 66.

Step 168: Search for the cyan dye frame 66. Because printing of the dye on the magenta dye frame 64 onto the photo paper has just finished, the photo sensor 74 must still be within the magenta dye frame 64. Continuously wind the ink ribbon 70. When the digital signal of the output signal generated by the photo sensor 74 goes from "0" to "1", the beginning position of the transparent dividing section 84 is detected. When the digital signal of the output signal generated by the photo sensor 74 goes from "1" to "0" again, the beginning position of the cyan dye frame 66 is detected. Then, start to print the dye on the cyan dye frame 66 onto the photo paper. Thereafter perform step 170 to search for the over coating dye frame 68.

Step 170: Search for the over coating dye frame 68. Because printing of the dye on the cyan dye frame 66 onto the photo paper has just finished, the photo sensor 74 must still be within the cyan dye frame 66. Continuously wind the ink ribbon 70. When the digital signal of the output signal generated by the photo sensor 74 goes from "0" to "1", the beginning position of the over coating dye frame 68 is detected. Then, start to print the dye on the over coating dye frame 68 onto the photo paper.

According to the above-mentioned steps, the color printer 60 in the present invention utilizes the timer 96 to record the status-to-status duration, and the status-to-status duration is compared with a threshold time $T_{th}$. As mentioned above, when the output signal goes from "1" to "0", the timer 96 starts to record the duration of "0", and the controller 90 compares the duration with the threshold time $T_{th}$, thereby determining the beginning position of the yellow dye frame 62. The yellow dye frame 62 serves as the beginning position of the ink ribbon 70 for printing the dye onto the photo paper. Thereafter, utilizing the variation in the output signals, the beginning position of the magenta dye frame 64, the cyan dye frame 66, and the over coating dye frame 68 can be determined. In this manner, the color printer according to the present invention can detect the position of the ink ribbon 70.

Figure 6:
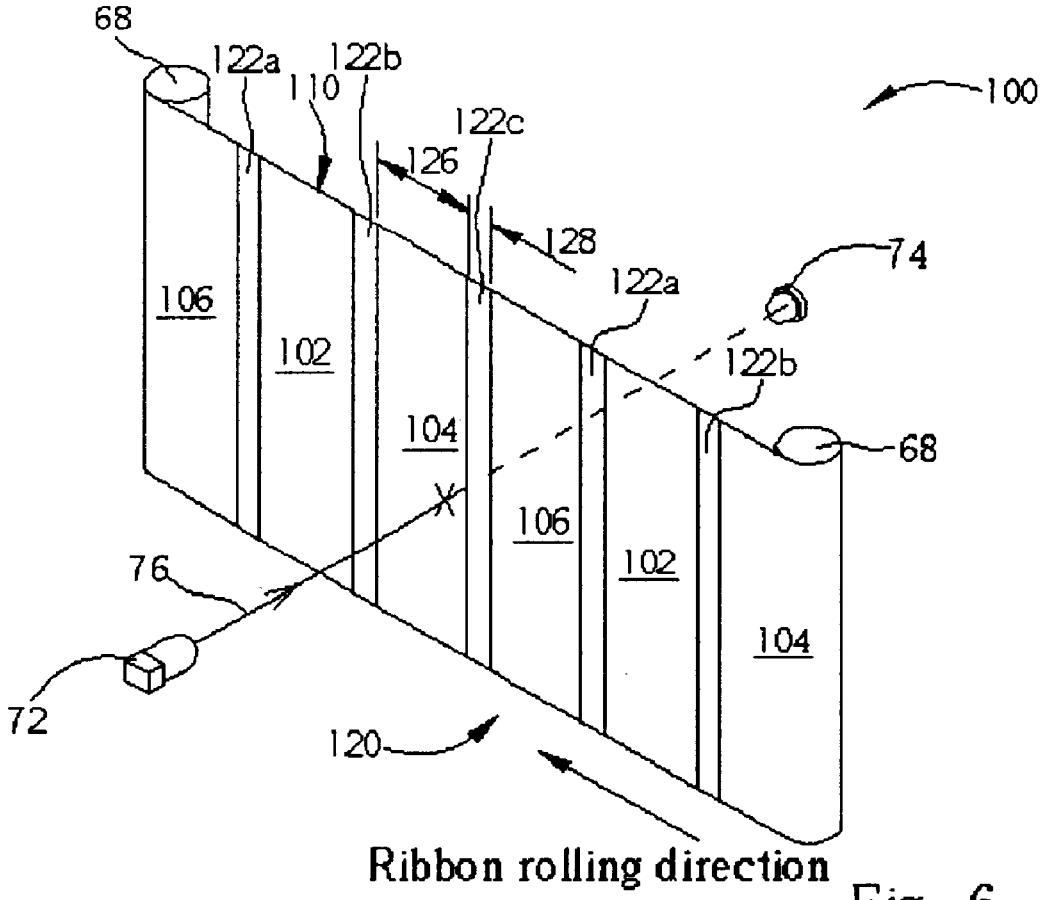
FIG. 6 is a schematic diagram of a ribbon apparatus 100 of a color printer according to the second embodiment of the present invention.
Figure 7:
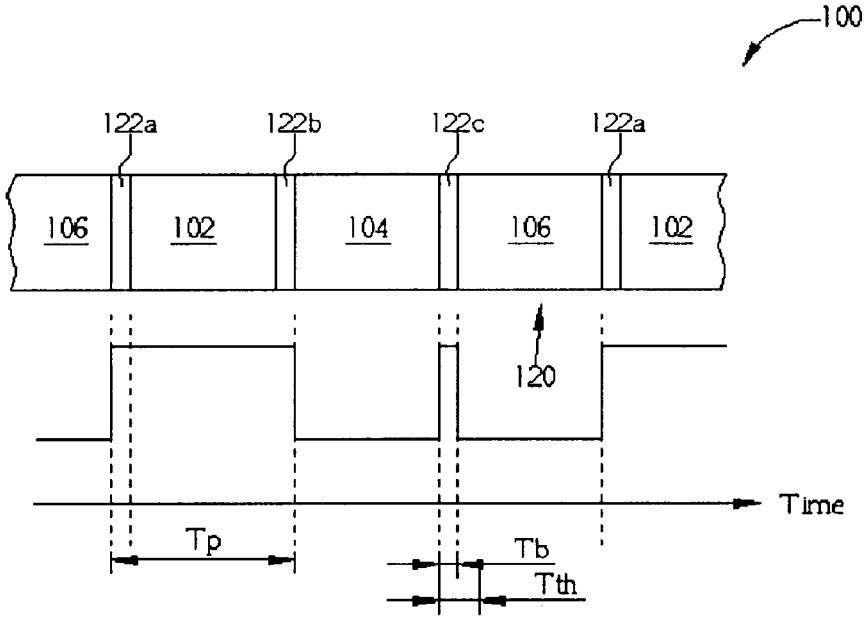
FIG. 7 is a time sequence diagram of the output signals generated by the optical sensing system shown in FIG. 6.

Please refer to FIG. 6 and FIG. 7. FIG. 6 is a schematic diagram of a color printer 100 according to the second embodiment of the present invention. FIG. 7 is a time sequence diagram of the output signals generated by the optical sensing system shown in FIG. 6. As shown in FIG. 6 and FIG. 7, the optical sensing system of the color printer 100 comprises a green light emitting diode as a green light source 92. The ink ribbon 110 comprises a plurality of sequentially arranged dye regions 120. Each of the dye regions 120 consists of three dye frames 102, 104, 106 for carrying dye of different colors and each of the dye frames 102, 104, 106 has a substantially equal first length 126. The dye frame 102, 104, 106 are used for separately placing yellow dye, magenta dye, and cyan dye. A dividing section 122 is positioned at the front end of each of the dye frames 102, 104, 106, and each dividing section 122 has a substantially equal second length 128. The dividing section 122 is transparent so that the controller 90 can discern a beginning position of each of the dye frame 102, 104, 106. Wherein the first length 126 is greater than the second length 128. In addition, the green light beam 76 emitted by the green light source 72 has higher penetration rates for the yellow dye frame 102 and the transparent dividing section 122. As a result, when the green light beam 76 passes through the yellow dye frame 102 and the transparent dividing sections 122, the output signal 78 is of the first status (i.e. high voltage status), and its digital signal is represented by "1". The green light beam 76 emitted by the green light source 72 has lower penetration rates for the magenta dye frame 104 and the cyan dye frame 106. Therefore, when the green light beam 76 passes through the magenta dye frame 104 and the cyan dye frame 106, the output signal 78 is the of second status (i.e. low voltage status), and its digital signal is represented by "0". When the controller 90 receives the output signal 78 generated by the photo sensor 74, the timer 96 records the status-to-status duration (such as the a low voltage status shifting from the high voltage status) of the output signal 78, and the controller 90 compares the status-to-status duration to a threshold time $T_{th}$ thereby determining the beginning position of the ink ribbon 110 (that is, the beginning position of the yellow dye frame 102) for printing the photo paper.

When the controller 90 utilizes the ribbon driving device 94 to wind the ink ribbon 110 inside the ribbon cartridge to make each of the dye frames 102, 104, 106 in the dye region 120 pass by the print head 92 sequentially, the photo sensor 74 detects the dye region 120 of the ink ribbon 110 to generate an output signal 78. When printing the dye on the dye frame 102, 104, 106 in a dye region 120 of the ink ribbon 110 onto the photo paper, the ribbon driving device 94 winds the ink ribbon 110 inside the ribbon cartridge at the constant linear speed. Each of the dye frames 102, 104, 106 has an equal sensing time generated by the timer 96 inside the controller 90. The sensing time of the yellow dye frame 102 and the two dividing sections 122*a*, 122*b* adjacent to the yellow dye frame 102 is referred to as a first time $T_p$. Similarly, the dividing section 122*a*, 122*b*, 122*c* has another sensing time, referred to as a second time $T_b$. The first time $T_p$ is longer than the threshold time $T_{th}$, which is longer than the second time $T_b$. In general, the printing order of the ink ribbon 110 is the yellow dye frame 102, the magenta dye frame 104, and the cyan dye frame 106. As a result, when determining the beginning position of the ink ribbon 110, the color printer has to search for the yellow dye frame 102, the magenta dye frame 104, and the cyan dye frame 106 in that order. The details are described as follows (please to FIG. 4, FIG. 6 and FIG. 7):Step 180: Search for the yellow dye frame 102. Turn on the green light source 72 and the photo sensor 74, and wind the ink ribbon 110 at the constant linear speed or at the constant angular speed.

Step 182: When the digital signal of the output signal goes from "0" to "1", the timer 96 starts to count time, and the ink ribbon 110 is continuously wound at the constant linear speed.

Step 184: When the digital signal of the output signal goes from "1" to "0" and the time recorded by the timer 96 is shorter than the threshold time $T_{th}$, the photo sensor 74 is still positioned within the cyan dye frame 106, and the search process goes back to step 182. When the time recorded by the timer 96 is longer than the threshold time $T_{th}$ and the digital signal of the output signal hasn't gone from "1" to "0" yet, the beginning position of the yellow dye frame 102 is detected and the color printer can start to print the dye on the yellow dye frame 62 onto the photo paper. Thereafter perform step 186 to search for the magenta dye frame 104.

Step 186: Search for the magenta dye frame 104. Because printing the dye on the yellow dye frame 102 onto the photo paper has just finished, the photo sensor 74 must be within the yellow dye frame 102. Continuously wind the ink ribbon 110. When the digital signal of the output signal generated by the photo sensor 74 goes from "1" to "0", the beginning position of the magenta dye frame 104 is detected. Then, start to print the dye on the magenta dye frame 104 onto the photo paper. Thereafter perform step 188 to search for the cyan dye frame 106.

Step 188: Search for the cyan dye frame 106. Because printing the dye on the magenta dye frame 104 onto the photo paper has just finished, the photo sensor 74 must still be within the magenta dye frame 104. Continuously wind the ink ribbon 110. When the digital signal of the output signal generated by the photo sensor 74 goes from "0" to "1", the beginning position of the transparent dividing section 122 is detected. When the digital signal of the output signal generated by the photo sensor 74 goes from "1" to "0" again, the beginning position of the cyan dye frame 106 is detected. Then, start to print the dye on the cyan dye frame 106 onto the photo paper.

According to the above-mentioned steps, the color printer 100 according to the second embodiment of the present invention utilizes the timer 96 to record the status-to-status duration, and the status-to-status duration is compared with a threshold time $T_{th}$. As mentioned above, when the digital signal of the output signal goes from "0" to "1", the timer 96 starts to record the duration of "1" and the controller 90 compares the duration with the threshold time $T_{th}$, thereby determining the beginning position of the yellow dye frame 102. The yellow dye frame 102 serves as the beginning position of the ink ribbon 110 for printing the dye onto the photo paper. By utilizing the variation of the output signals, the beginning position of the magenta dye frame 104 and the cyan dye frame 106 can be determined. In this manner, the color printer according to the present invention can detect the position of the ink ribbon 110.

A green light source 72 is used as an example in the above-mentioned embodiments of the present invention. However, the present invention is not limited to a green light source 72. Light source emitting light beams of other colors can be utilized to detect the position of the ink ribbon 70, 110. Only a slight modification in signaling orders is required to achieve the same purpose as the present invention. The embodiments mentioned in this specification only describe cases where the light source and the optical sensor are installed on opposite sides of the ribbon. However, the light source and the optical sensor may be installed on the same side if a reflector is installed on the opposite side of the ink ribbon for reflecting the light beam emitted from the light source back to the optical sensor for generating output signals. In addition, the above-mentioned timer can be replaced with a pedometer. When a step motor winds an ink ribbon, a pedometer counts steps of the step motor when winding the ink ribbon, thereby determining the position of the ink ribbon.

Compared to the prior color printer, the color printer of the present invention needs only a single optical sensing system to detect the position of the ink ribbon. The beginning position of each dye frame in the ink ribbon is determined by a digital method, and therefore, production costs are lowered.

Those skilled in the art will readily observe that numerous modifications and alterations of the device may be made while retaining the teachings of the invention. Accordingly, the above disclosure should be construed as limited only by the metes and bound of the appended claims.

What is claimed is:

1. A color printer comprising:

an ink ribbon comprising a plurality of dye regions and a plurality of dividing sections for dividing said plurality of dye regions, each dye region comprising a plurality of dye frames for carrying dye of different colors, the ink ribbon further comprising a plurality of dividing sections for dividing said plurality of dye frames;

a print head for transferring said dye on the ink ribbon onto an object to form a desired pattern;

a ribbon driving device for moving said ink ribbon in a predetermined direction;

a single optical sensing system positioned adjacent to said ink ribbon for illuminating said ink ribbon and thereby producing an associated output signal comprising a first status and a second status; and a controller for controlling said color printer, said controller being capable of detecting a position of a dye frame of a first color according to a duration of a status of said output signal, and detecting positions of subsequent dye frames of second and third colors only according to changes of the status of the output signal.

2. The color printer of claim 1, wherein said color printer comprises only one optical sensing system and said output signal comprises only said first status and said second status.

3. The color printer of claim 1, wherein said single optical sensing system comprises a light source for emitting light having a pre-selected wavelength and a photo sensor, which generates said output signal by detecting light which is emitted from said light source and penetrates said ink ribbon.

4. The color printer of claim 1, wherein said output signal is a voltage signal, and said first status and said second status are a high voltage status and low voltage status, respectively.

5. The color printer of claim 1, wherein said ribbon driving device rolls said ink ribbon at a substantially constant speed.

6. The color printer of claim 1, wherein said first color is yellow, said second color is magenta, and said third color is cyan, one of said dye frames within each said dye region is an over coating dye frame, said dividing section before said yellow dye frame is opaque, said dividing sections before said magenta dye frame, said cyan dye frame, and said over coating dye frame are transparent.

7. The color printer of claim 6, wherein said light source is a green light LED, and wherein when said green light LED emits green light to illuminate said yellow dye frame, said over coating dye frame, said transparent dividing sections, said optical sensing system outputs said first status; when said green light LED emits green light to illuminate said magenta dye frame, said cyan dye frame, and said opaque dividing section, said optical sensing system outputs said second status.

8. The color printer of claim 1 further comprising a ribbon cartridge for storing said ribbon, and said ribbon driving device causes said ribbon stored in said ribbon cartridge to move in a predetermined direction.

9. The color printer of claim 1, wherein said color printer is a photo printer.

10. A color printer comprising:

an ink ribbon comprising a repeating sequence of dye frames;

a print head for transferring dye on the ink ribbon onto an printing medium;

a ribbon driving device for moving the ink ribbon in a predetermined direction at a substantially constant speed;

an optical sensing system positioned adjacent to the ink ribbon for illuminating the ink ribbon and generating an output signal having a first status or a second status depending on the color of dye frame illuminated; and a controller electrically connected to the optical sensing system for determining a color of a dye frame adjacent to the print head; the controller determining that a beginning of a dye frame of a first color is adjacent to the print head when the output signal changes from the second status to the first status and a duration of said second status is shorter than a predetermined threshold time, and determining that beginnings of subsequent dye frames are adjacent to the print head exclusively based on subsequent changes of the output signal between the first and second statuses.

11. The color printer of claim 10, wherein the output signal is a voltage signal, the first status being a high voltage level and the second status being a low voltage level.

12. The color printer of claim 10, wherein the first color is yellow, and subsequent dye frames of the repeating sequence in order opposite the predetermined direction are: magenta dye, the transparent dye or undyed transparent ribbon, cyan dye, transparent over coating dye, opaque dye.

13. The color printer of claim 12, wherein the optical sensing system comprises a green light LED; wherein when the green light LED emits green light to illuminate the yellow dye frame, the over coating dye frame, or the transparent dye or undyed transparent ribbon, the optical sensing system generates the output signal at the first status; and when the green light LED emits green light to illuminate the magenta dye frame, the cyan dye frame, or the opaque dye frame, the optical sensing system generates the output signal at the second status.

* * * * *